US005889733A

United States Patent [19]

Kubo et al.

[11] Patent Number: 5,889,733

[45] Date of Patent: Mar. 30, 1999

[54] TIMER DEVICE FOR DISTRIBUTOR TYPE FUEL INJECTION APPARATUS

[75] Inventors: Kenichi Kubo; Tatsuo Nakajima, both of Higashimatsuyama, Japan

[73] Assignee: Zexel Corporation, Tokyo, Japan

[21] Appl. No.: 49,040

[22] Filed: Mar. 27, 1998

[30] Foreign Application Priority Data

Mar. 28, 1997 [JP] Japan ..... 9-094690

[51] Int. Cl.[6] ..... G04B 47/00; F02M 41/00; F02M 37/04

[52] U.S. Cl. ..... 368/10; 123/448; 123/502; 417/462

[58] Field of Search ..... 368/10, 107–113; 123/448–450, 458, 502, 503, 506; 417/462

[56] References Cited

U.S. PATENT DOCUMENTS

| | | | |
|---|---|---|---|
| 4,593,669 | 6/1986 | Igarashi | 123/502 |
| 5,085,195 | 2/1992 | Yoshizu | 123/502 |
| 5,513,965 | 5/1996 | Nakamura et al. | 417/462 |
| 5,531,204 | 7/1996 | Serigushi | 123/502 |
| 5,619,971 | 4/1997 | Kubo et al. | 123/450 |
| 5,647,323 | 7/1997 | Kubo et al. | 123/450 |

*Primary Examiner*—Vit Miska
*Attorney, Agent, or Firm*—Wenderoth, Lind & Ponack, L.L.P.

[57] ABSTRACT

In a timer device having a timer sleeve at a housing with a timer piston slidably provided at the timer sleeve, a high pressure chamber is constituted by securing to the housing a high pressure side cover member constituted as an integrated part of the timer sleeve. The high pressure chamber and a passage at the housing communicating with a chamber are connected to each other by a passage formed in high pressure side cover member. A check valve for absorbing shock waves generated within the high pressure chamber is provided in the passage in the high pressure side cover member. The passage can be designed and manufactured with ease, and at the same time, the timer piston and the check valve can be separately designed and manufactured. Furthermore, stable operation of the check valve is achieved.

16 Claims, 5 Drawing Sheets

TIMER DEVICE FOR DISTRIBUTOR TYPE FUEL INJECTION APPARATUS

BACKGROUND OF THE INVENTION

1. Field of the Invention

The present invention relates to a timer device that is employed to adjust the quantity of advance angle in a distributor type fuel injection pump, typical examples of which include a VE type fuel injection pump and a VR fuel injection pump.

2. Description of the Related Art

Timer devices in the prior art include, for instance, the timer device disclosed in Japanese Unexamined Patent Publication No. H 8-42362. In this publication, a timer device for a VR type fuel injection pump is disclosed. This timer device includes a cylindrical steel pipe mounted at a non-ferrous pump housing, with a timing piston slidably inserted in the steel pipe. A low pressure chamber provided with a return spring is formed at one end of the timing piston, and a high pressure chamber enclosed by an integrated flange (which, together with the steel pipe, constitutes an integrated unit) is formed at another end of the timing piston passage that communicates with the outlet side of a feed pump is connected to the high pressure chamber.

In addition, since an impact force (drive reactive force) is applied to the timer piston when the rollers ride up the cam lobes, an impact valve and a drain are provided at the timer piston so that any displacement of the timer piston caused by the impulse force is prevented, to stabilize the advance angle.

Furthermore, in the same publication, a structure is disclosed in which the timer piston is slidably inserted in a steel pipe which is internally fitted in the housing. A high pressure chamber is formed at one end of the timer piston with the low pressure chamber formed at the other end of the timer piston by closing off the two ends of the steel pipe with separate disks that are secured to the housing by bolts.

When forming the high pressure chamber with the integrated flange which, together with the steel pipe, constitutes an integrated unit, the clearance between the steel pipe and the timer piston can be maintained almost constant even if the temperature changes, by constituting the steel type and the timer piston of the same material. This is done to prevent the fuel from leaking through a clearance caused by a difference in thermal expansion that exists when different materials are used to constitute the steel pipe and the timer piston, and to greatly facilitate the seal management at the high pressure side. However, in the structure described above, in which a valve mechanism (impact valve) is provided inside the timer piston to absorb the shock wave generated in the high pressure chamber, i.e., a moving member is provided inside another moving member, there is a problem in that the movement of the timer piston is directly communicated to the valve mechanism to prevent stable movement of the valve mechanism.

In addition, in the structure described above, in which the high pressure chamber and the passage through which the fuel is supplied to the high pressure chamber are made to communicate with each other via the valve mechanism provided at the timer piston, the individual passages must be designed and machined by anticipating the range of movement of the timer piston in order to assure such a communicating state regardless of where the timer piston is positioned. This tends to make the design and machining more difficult and is likely to complicate the structure itself.

Furthermore, if the valve mechanism is to be provided inside the timer piston by machining the timer piston, full consideration must be given to ensure that the timer piston does not become deformed and, at the same time, careful design is required to ensure that damage to the valve mechanism does not directly result in damage to the timer piston.

Thus, when the various factors of the structure described above are taken into consideration as a whole, the structure cannot be considered practical from a design standpoint in terms of productivity, durability, reliability and the like.

In addition, in a timer device in which the steel pipe and the flange are constituted separately (a timer device in which a high pressure chamber is formed by providing a separate disk at an opening end of the steel pipe), the seal member may become exposed to a high pressure fuel depending upon the seal structure at the high pressure chamber side, thereby risking having the seal member directly subject to the effect of the shock wave generated by the drive reactive force. In addition, if separate disks are to be secured to the housing with bolts, the mounting bolts are often provided in the vicinity of the steel pipe in order to save space and achieve miniaturization. In such a case, it is possible that the internal surface of the cylindrical hole of the housing through which the steel pipe is inserted will become distended or deformed when the bolts are tightened, which may, in turn, result in the sliding surface of the steel pipe becoming deformed and prevent the timer piston from sliding smoothly.

SUMMARY OF THE INVENTION

Accordingly, an object of the present invention is to provide a timer device for a distributor type fuel injection apparatus that achieves an improvement in productivity, durability and reliability by, in particular, improving the structure of the high pressure side of the timer device which has a timer sleeve provided in a housing and a timer piston slidably provided in the timer sleeve.

In addition, with the object described above to be fulfilled as a prerequisite, another object of the present invention is to achieve a simplification in the design and production of communicating passages connected to the high pressure chamber and also to achieve stable operation of the valve mechanism by ensuring that the movement of the timer piston is not directly communicated to the valve mechanism. Yet another object of the present invention is to achieve protection of the seal member at the high pressure side to prevent damage to and deformation of the timer sleeve.

In order to achieve the objects described above, in the timer device for a distributor type fuel injection apparatus according to the present invention, which is constituted by slidably inserting a timer piston for adjusting the quantity of advance angle into a timer sleeve secured to a housing, providing a high pressure chamber communicating with a high pressure side fuel path at one end of the timer piston and providing a low pressure chamber communicating with a low pressure side fuel path at the other side, and providing a timer spring at the low pressure chamber to adjust the position of the timer piston through the balance between the pressure difference between the high pressure chamber and the low pressure chamber and the spring force imparted by the timer spring. By modifying the structure of the high pressure side, in particular as described below, the productivity, durability and the like of the timer device are improved.

First, a high pressure chamber is constituted by securing a high pressure side cover member which is integrated with the timer sleeve to the housing, and a low pressure chamber is constituted by securing to the housing a low pressure side cover member which is a unit separate from the timer sleeve. While such a structure itself is disclosed in FIG. 3 of the publication mentioned above (Japanese Unexamined Patent Publication No. H8-42362), according to the present invention, a communicating passage which connects the high pressure chamber to a passage that communicates with the high pressure side fuel path is directly provided on the inside of the high pressure side cover member. This structure may be directly adopted in a timer device in which the pressure difference between the high pressure chamber and the low pressure chamber is adjusted through a timing control valve by providing the timing control valve in the passage communicating with the high pressure side fuel path.

Consequently, by varying the pressure difference between the pressure in the high pressure chamber and the pressure in the low pressure chamber, the positional adjustment of the timer piston is achieved, and during this process, fuel is supplied to the high pressure chamber via the communicating passage formed at the high pressure side cover member, or fuel is allowed to flow out of the high pressure chamber. While it is necessary to avoid interference with other passages formed in the housing if the passage communicating with the high pressure chamber is formed in the housing, as in the prior art, the passage can be formed independently, without having to be concerned about interference with other passages if it is to be formed at the high pressure side cover member as in the present invention, thereby facilitating both the design and the production.

In addition, it is desirable to provide a valve mechanism at the high pressure side cover member, that constricts the communicating passage when the fuel pressure in the high pressure chamber becomes higher than the fuel pressure within the passage communicating with the high pressure side fuel path, and releases the constriction of the communicating passage when the fuel pressure in the high pressure chamber becomes lower than the fuel pressure within the passage communicating with the high pressure side fuel path.

In a VR pump and a VE pump, the pressure in the high pressure chamber increases sharply every time the rollers begin to ride up the cam lobes to allow the fuel within the high pressure chamber to flow out through the communicating passage, and the communicating passage becomes constricted as soon as the pressure in the high pressure chamber increases to block the communication of the shock wave with the valve mechanism provided at the communicating passage, which will reduce fluctuation of the timer piston to achieve a stable timer advance angle. In contrast, when the fuel pressure in the high pressure chamber becomes lower than the fuel pressure in the passage communicating with the high pressure side fuel path, the constriction of the communicating passage is released to immediately guide the high pressure fuel to the high pressure chamber.

Since such a valve mechanism is provided at the high pressure side cover member away from the timer piston and, therefore, the vibration of the timer piston is not directly communicated to the valve mechanism, the valve mechanism will operate entirely on the difference between the fuel pressure in the high pressure chamber and the fuel pressure in the passage communicating with the high pressure side fuel path. Furthermore, the valve mechanism and the timer piston can be designed and manufactured separately, with the likelihood of damage to the valve mechanism directly resulting in damage to the timer piston reduced.

Now, when constituting the high pressure chamber with the high pressure side cover member which is a unit separate from the timer sleeve, a seal member must be provided between the housing and the high pressure side cover member in order to improve the seal at the high pressure chamber. In this structure, a projecting portion whose shape is matched to the internal shape of the end portion of the timer sleeve is formed at the high pressure side cover member so that, when the high pressure side cover member is secured at the housing, this projecting portion is fitted inside the opening end portion of the timer sleeve.

Since this projecting portion does not necessarily have to be pressed tightly into the opening end, it may be pressed lightly into the timer sleeve or may be fitted only partially in to achieve its purpose and does not have to be fitted into the timer sleeve over a large distance. In this structure, the seal member is provided on the outside of the high pressure chamber and the pressure in the high pressure chamber is not directly applied to the seal member. As a result, even if a shock wave is generated within the high pressure chamber, the seal member will not be affected, thus assuring an increase in the service life of the seal member.

In addition, the ratio (L/D) of the slidable range (L) of the timer piston to its diameter (D) may be used as a reference for determining the performance of the timer piston. The smaller this value is, the greater the degree to which smooth movement of the timer piston is hindered, and the greater the value is, the better the likelihood that smooth movement of the timer piston can be assured. According to the present invention, a larger value can be achieved for L by limiting how far the projecting portion is fitted in, to set L/D at an advantageous value.

While the high pressure side cover member and the low pressure side cover member are secured to the housing with bolts or the like under normal circumstances, it is desirable to provide a seal member between the housing and the timer sleeve at the opening end portion of the timer sleeve and to form a gap from the position at which the seal member is provided along the external circumferential surface of the timer sleeve in such a structure. In particular, at the opening end portion of the timer sleeve in which the projecting portion at the high pressure side is fitted, the gap between the housing and the timer sleeve should be formed extending to a position further away from the opening end than the projecting portion.

By providing such a gap, it becomes possible to absorb any deformation of the housing that may occur due to bolt tightening, and since the deformation of the timer sleeve caused by deformation of the housing is prevented, the timer piston can be prevented from sliding in a defective manner. In addition, while there is a concern that at the timer sleeve end portion in which the projecting portion is fitted, the diameter of the timer sleeve may slightly increase when the projecting portion is fitted therein, resulting in the end portion of the timer sleeve becoming tightly sandwiched between the housing and the projecting portion and becoming damaged, the gap provided as described above prevents a large stress from being applied to the timer sleeve so that the timer sleeve will not become damaged.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

Figure 1:
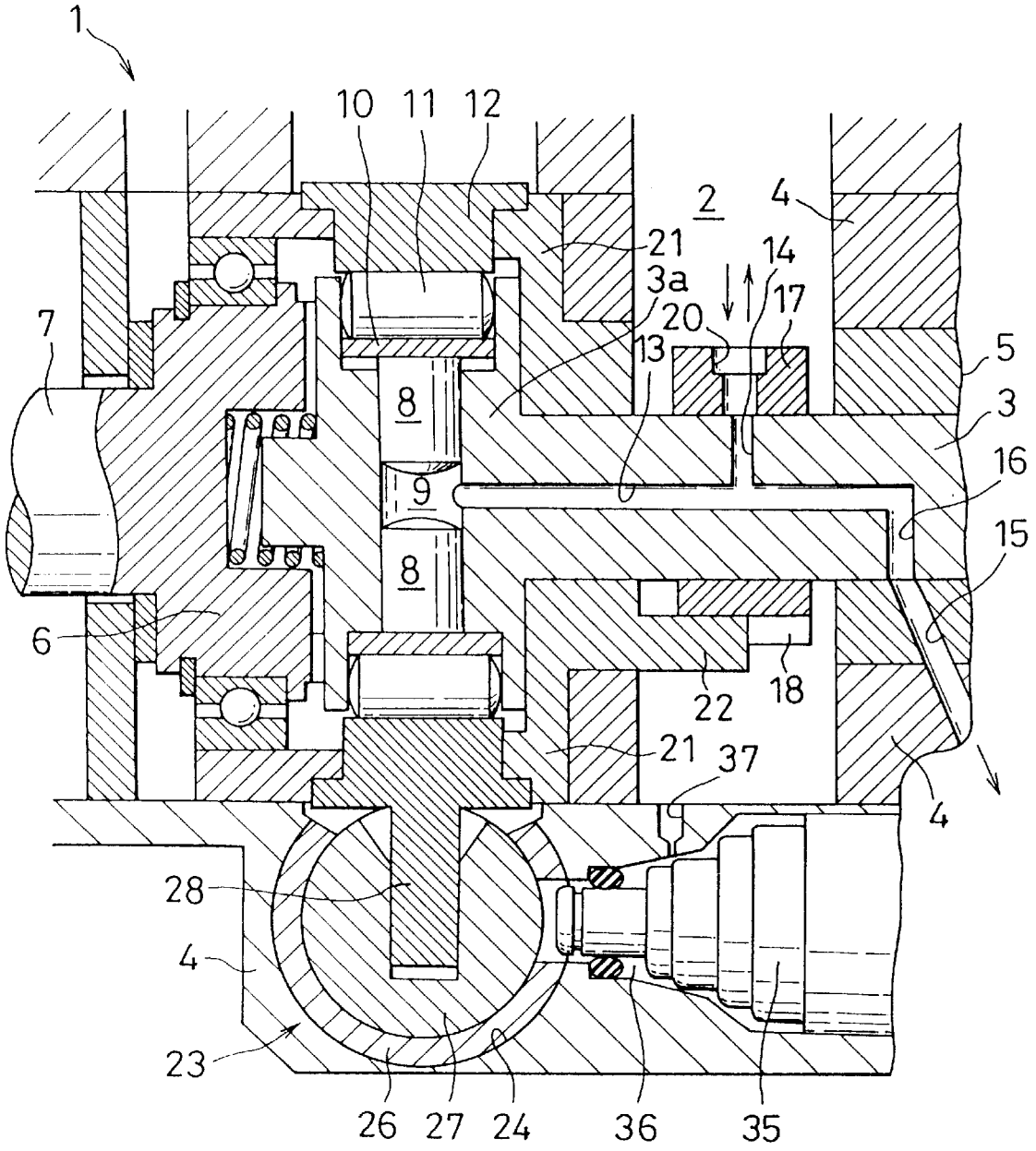
FIG. 1 is a cross section illustrating an essential portion of a VR distributor type fuel injection apparatus adopting the present invention.
Figure 2:
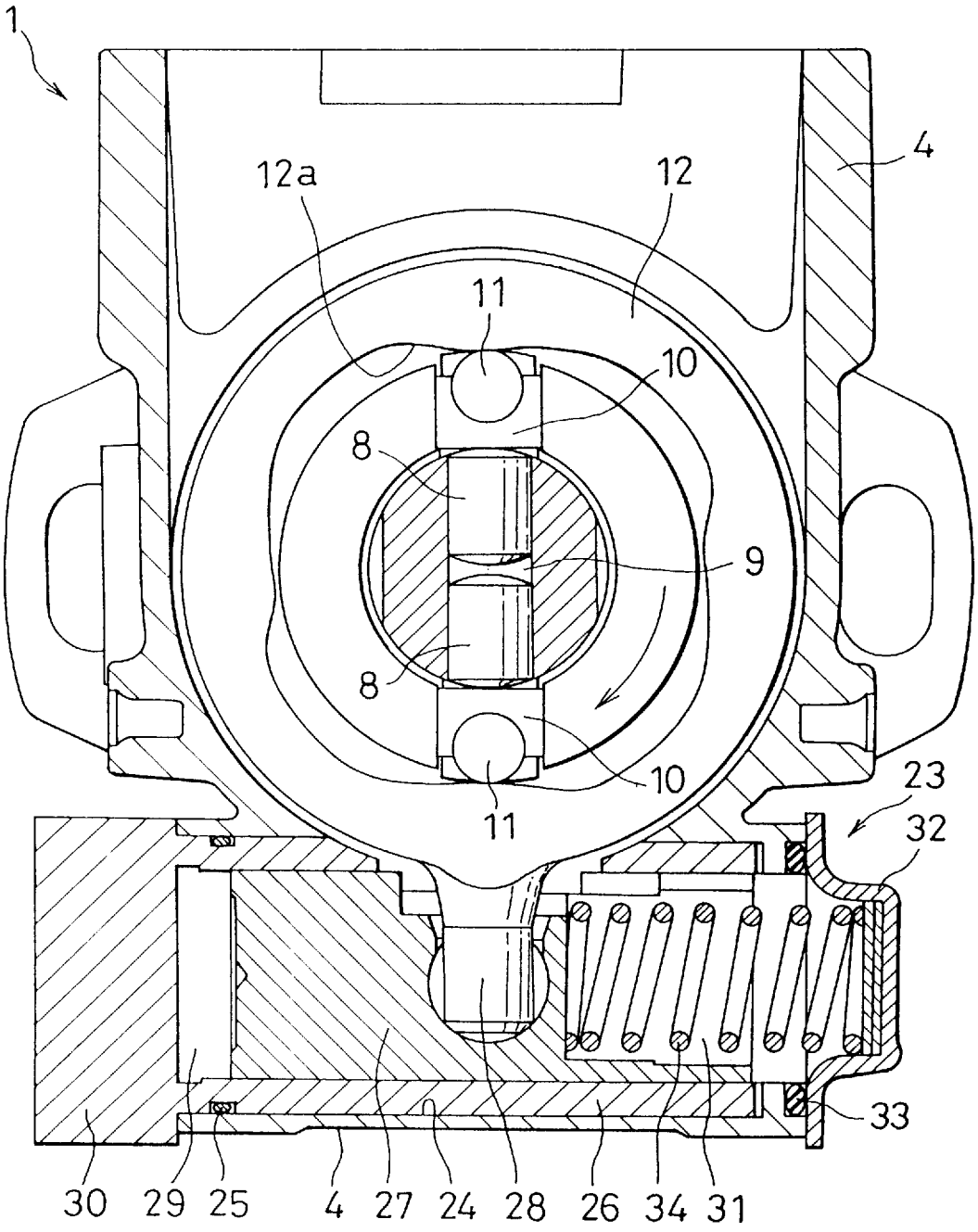
FIG. 2 is a cross section of the fuel injection apparatus shown in FIG. 1 cut in the vertical direction to expose its cam ring and timer piston.

The following is an explanation of the preferred embodiments of the present invention with reference to the drawings. In FIGS. 1 and 2, which illustrate an essential portion of a distributor type fuel injection pump adopting an inner-cam system, the distributor type fuel injection pump 1 is provided with a chamber 2 into which a fuel is guided via a feed pump (not shown), and a distribution member 3 which intersects the chamber 2 rotatably inserted at a barrel 5 secured to a pump housing 4. A base end portion 3*a* of the distribution member 3 is linked to a drive shaft 7 via a coupling 6 so that it is only allowed to rotate in synchronization with the engine. In addition, plungers 8 are slidably inserted at the base end portion 3*a* of the distribution member 3 in the direction of the radius (in the radial direction).

In this embodiment, two plungers 8, for instance (or four plungers) are provided over 180° intervals (or 90° intervals) on the same plane. At the base end portion of the distribution member 3 that links with the drive shaft, plungers 8 are inserted slidably in the direction of the radius (radial direction), as shown in FIG. 2. In this structural example, four plungers 8 are provided on the same plane over 90° intervals. The front end of each of the plungers 8 blocks off and faces a compression space 9 which is provided at the center of the base end portion of the distribution member 3. The base end of each plunger 20 slides in contact with the internal surface of a ring-like cam ring 12 via a shoe 10 and a roller 11. This cam ring 12 is provided concentrically around the distribution member 3, with cam lobes 12*a*, the number of which corresponds to the number of cylinders in the engine, formed on the inside so that when the distribution member 3 rotates, each plunger 8 makes reciprocal movement in the direction of the radius of the distribution member 3 (radial direction) to vary the volumetric capacity of the compression space 9.

A longitudinal hole is formed in the axial direction, communicating with the compression space 9. Inflow/outflow ports 14, which communicate with the longitudinal hole 13, and the number of which corresponds to the number of cylinders, are formed at the circumferential surface of the distribution member 3. A distribution port 16 is formed in the distribution member and allows communication between distribution passages 15 formed in the barrel 5 and the pump housing 4, and the longitudinal hole 13. In addition, a control sleeve 17 provided in the chamber 2 is slidably fitted about the distribution member 3, and covers the inflow/outflow ports 14.

At the control sleeve 17, a lateral groove (not shown) extending in the circumferential direction, a longitudinal groove 18 extending parallel to the direction of the axis of the distribution member and a communicating hole 20 which can come into communication with the inflow/outflow ports 14 of the distribution member 3 are formed. An eccentric connecting portion provided at the shaft of an electric governor (not shown) is made to connect with the lateral groove at the control sleeve 17, and when the shaft of the electric governor is caused to rotate, the control sleeve 17 is caused to become displaced relative to the axial direction of the distribution member 3. In addition, a retaining portion 22 of a link member 21 which interlocks with the cam ring 12 while maintaining a specific relationship is retained at the longitudinal groove 18, and when the cam ring 12 is caused to rotate by a timer device which is to be detailed later, the control sleeve 17, too, is caused to rotate in the same direction while maintaining a specific relationship.

Thus, when the distribution member 3 rotates, the plungers 8 make reciprocal movement in the direction of the radius of the distribution member 3 and the inflow/outflow ports 14, are placed in communication with the communicating hole 20 of the control sleeve 17 sequentially and, in an intake phase, during which the plungers 8 move away from the center of the cam ring 12, an inflow/outflow port 14 and the communicating hole 20 become aligned to allow the fuel to be taken into the compression space 9 from the chamber 2. Then, when the operation enters the force-feed phase, during which the plungers 8 move toward the center of the cam ring 12, the communication between the inflow/outflow ports 14 and the communicating hole 20 is cut off, the distribution port 16 and one of the fuel distribution passages 15 become aligned and compressed fuel is delivered from a delivery valve via this fuel distribution passage 15. After this, the fuel delivered from the delivery valve 7 is sent to an injection nozzle via an injection pipe (not shown) to be injected into a cylinder of the engine from the injection nozzle. Then, when the next inflow/outflow port 14 comes into communication with the communicating hole 20 during the force-feed phase, the compressed fuel flows out into the chamber 2 to radically reduce the fuel pressure of the fuel delivered to the injection nozzle, thereby ending the injection.

The process described above is implemented for the number of times corresponding to the number of cylinders per rotation of the distribution member 3, and the injection end timing with which an inflow/outflow port 14 and the communicating hole 20 come into communication with each other in each process is adjusted through the adjustment of the position of the control sleeve 17 in the axial direction. As the control sleeve 17 is moved in the direction in which the injection end timing is delayed, the injection quantity increases, whereas as it is moved in the direction in which the injection end timing is hastened, the injection quantity is reduced.

A timer device 23 is provided with a timer sleeve 26 which is fitted inside a cylindrical hole 24 formed in the housing 4 under the cam ring 12 via a seal member 25, and a timer piston 27 which is slidably housed in the timer sleeve 26. A slide pin 28 constituted as an integrated part of the cam ring 12 is linked to the timer piston 27 in the direction of the radius via a notch formed in the timer sleeve 26 to convert the linear movement of the timer piston 27 to a rotating movement of the cam ring 12.

Figure 3:
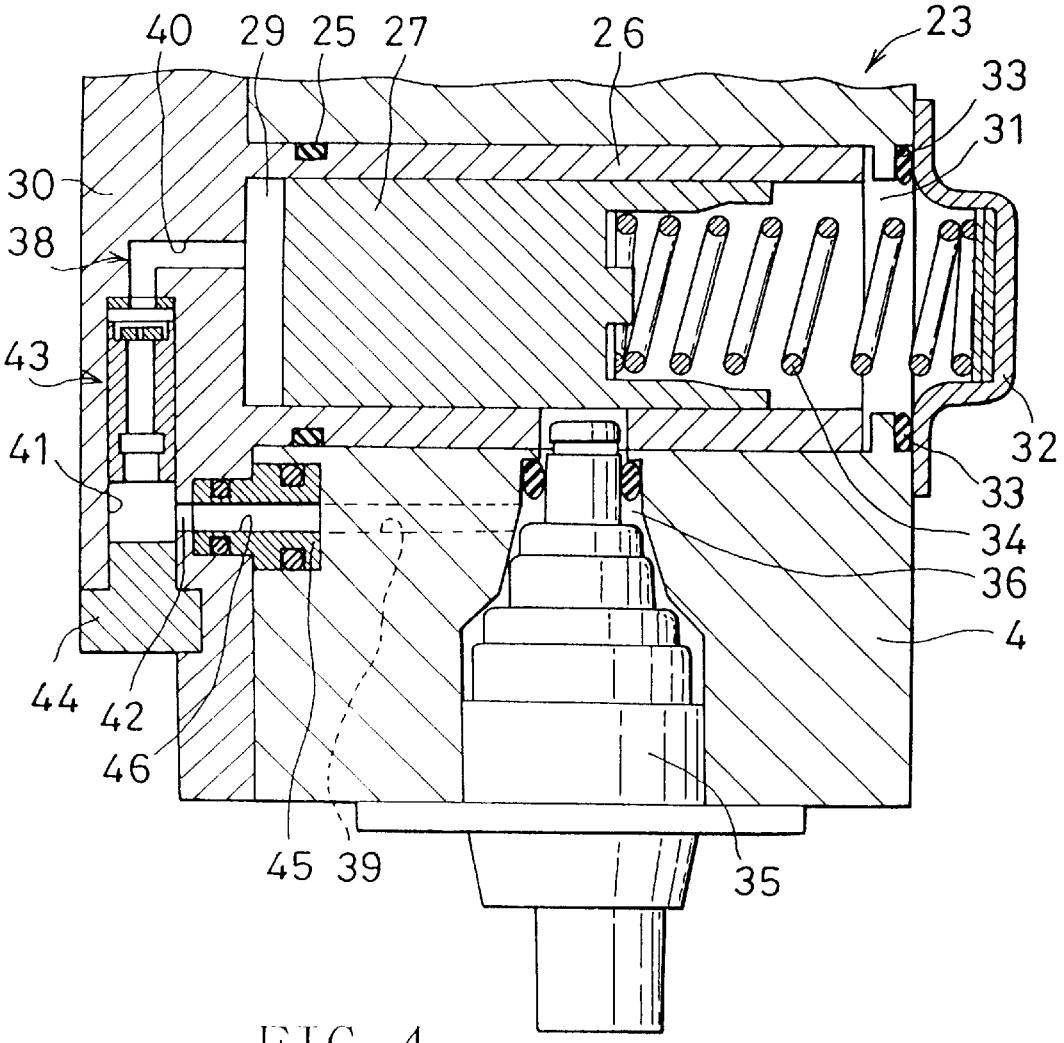
FIG. 3 is a cross section of the fuel injection apparatus shown in FIG. 1, cut in the horizontal direction to expose its timer piston and timing control valve (TCV)

To explain this structure more specifically, as shown in FIG. 3, a high pressure chamber 29, into which a high pressure fuel within the chamber is guided, is formed at one end of the timer piston 27 and a low pressure chamber 31 which communicates with the intake side path of the feed pump is formed at the other end thereof. The high pressure chamber 29 is constituted by securing a high pressure side cover member 30 constituted as an integrated part of the sleeve 26 to the housing 4, whereas the low pressure chamber 31 is constituted by securing a low pressure side cover member 32 which is formed separately from the timer sleeve 26 to the housing 4 via a seal member 33. A timer spring 34 is provided in the low pressure chamber 31, and a force is applied to the timer piston 27 by the timer spring 34 toward the high pressure chamber at all times. Thus, the timer piston 27 stops at the position where the spring pressure imparted by the timer spring 34 and the pressure difference between the pressure in high pressure chamber and the pressure in the low pressure chamber are in balance. When the pressure in the high pressure chamber increases, the timer piston 27 moves toward the low pressure chamber against the force of the timer spring 34. This causes the cam ring 12 to rotate in the direction in which the injection timing is advanced, which, in turn, causes the control sleeve 17 to rotate in the same direction via the link member 21, to hasten the injection timing. In addition, when the pressure in the high pressure chamber falls, the timer piston 27 is caused to move toward the high pressure chamber by the force of the timer spring 34, which, in turn, causes the cam ring 12 to rotate in the direction in which the injection timing is delayed, and as a result, the control sleeve 17, too, is caused to rotate in the same direction via the link member 21, thereby retarding the injection timing. It is to be noted that in this structural example, the housing 4 is constituted of aluminum and the timer piston 27, the sleeve 26 and the high pressure side cover member 30, which is formed as an integrated part of the sleeve 26, are constituted of steel.

Figure 4:
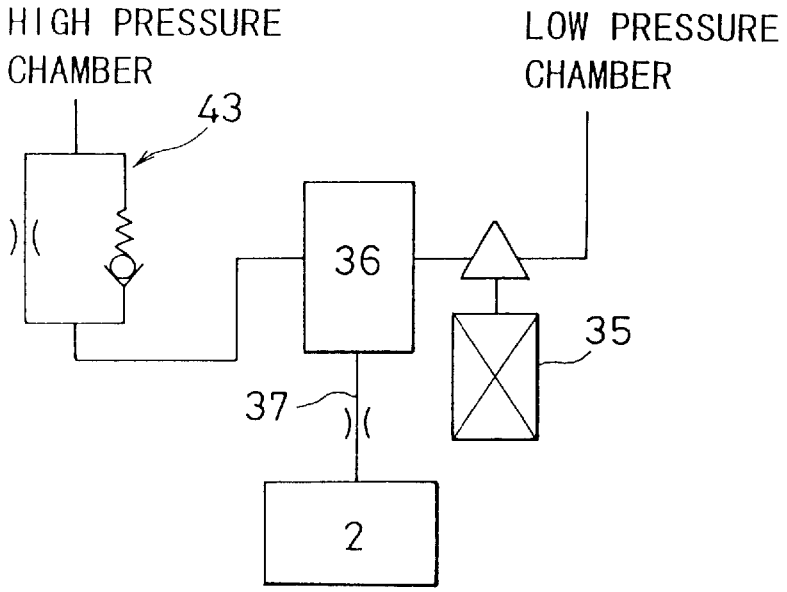
FIG. 4 is a schematic illustration of the timer device.

The pressure in the high pressure chamber 29 of the timer device 23 is adjusted by a timing control valve (TCV) 35 so that the required timer advance angle is achieved. To explain the function fulfilled by the timing control valve (TCV) 35, as illustrated in FIG. 4, the intake portion of the TCV 35 is formed facing opposite a side space 36 formed between itself and the housing 4, with the side space 36 communicating with the chamber 2 via a communicating passage 37 with an orifice (shown in FIGS. 1 and 4) and also communicating with the high pressure chamber 29 of the timer device via a check valve 43 to be detailed later. In addition, at the front end portion of the TCV 35, an outlet portion which communicates with the low pressure chamber 31 via the clearance formed between the timer piston 27 and the timer sleeve 26 or via a groove formed at the timer piston 27 or the timer sleeve 26 is formed with a valve element that achieves and cuts off the communication between the intake portion and the outlet portion housed in the TCV 35. Communication between the intake portion and the outlet portion is achieved and cut off by turning on/off the power supply to a solenoid (not shown), and when the intake portion and the outlet portion come into communication with each other to cause the side space 36 to come into communication with the low pressure chamber 31, the high pressure fuel is spilled into the low pressure chamber 31, to lower the pressure in the high pressure chamber 29. Consequently, through the adjustment of the state of power supply to the solenoid, the pressure difference between the pressure in the high pressure chamber and the pressure in the low pressure chamber can be adjusted so that the timer piston 27 can be caused to move to a desired advance angle position. It is to be noted that in practical application, the TCV 35 may operate under duty ratio control.

Now, the high pressure chamber 29 and the side space 36 are made to communicate with each other through a passage 38 formed in the high pressure side cover member 30 and a passage 39 formed in the housing 4. The passage 38 formed in the high pressure side cover member 30 is constituted of a first hole 40 which is bored from the inside of the sleeve 26 in the direction of the axis of the sleeve (in the direction of the thickness of the cover member), a second hole 41 which is bored at a right angle to the first hole 40 from a side to connect with the first hole 40 and a third hole 42 which is bored from the end surface that is in contact with the housing 4 to connect with the second hole 41. The diameter of the second hole 41 is set large except for in the vicinity where it connects with the first hole 40, so that the check valve 43 is inserted at this area, with an opening end portion at the side sealed off by a lid body 44 with a very tight seal.

The passage 39 formed in the housing 4 opens into the side space 36 at one end, with another end opening at the contact portion where it comes in contact with the high pressure side cover member 30. The passage 39 and the third hole 42 are made to communicate with each other via a communicating hole 46 of a relay member 45 provided between the housing 4 and the high pressure side cover member 30. This relay member 45 is sealed by 0-rings between itself and the housing 4 and between itself and the high pressure side cover member 30.

Figure 5A:
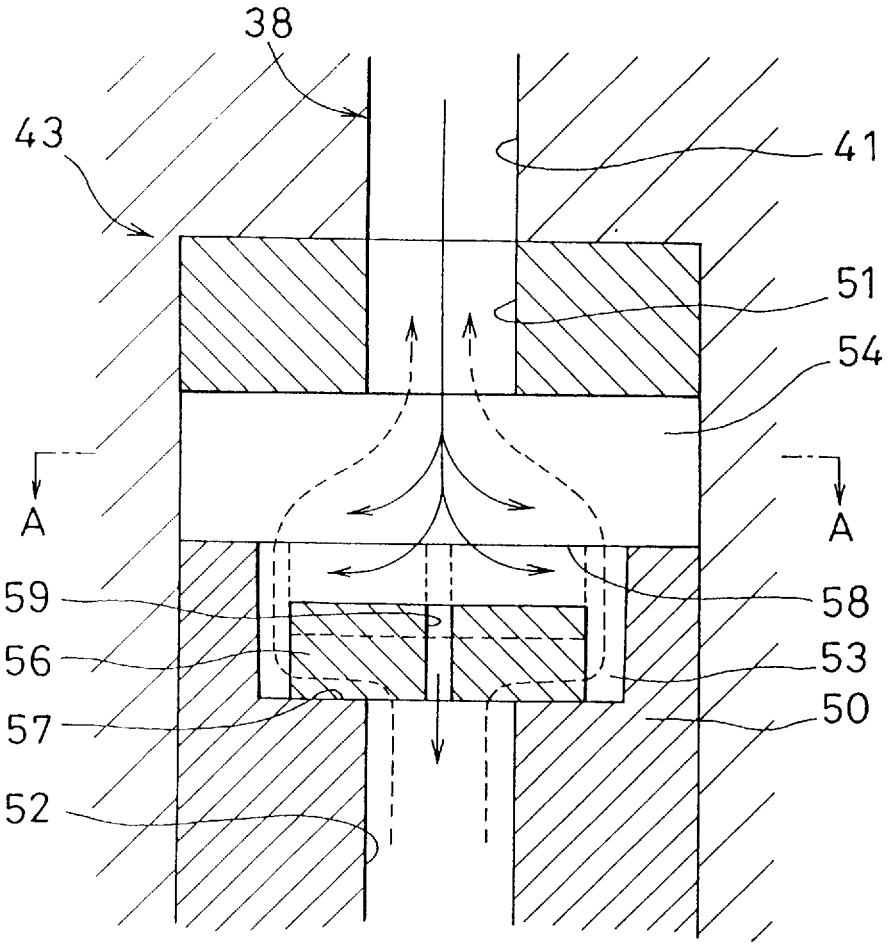
FIG. 5 is an enlargement of the check valve illustrated in FIG. 3, with FIG. 5A presenting a cross section across the various passages of the check valve.
FIG. 5B presenting a cross section through line $A_{13}A$ in FIG. 5A.
Figure 5B:
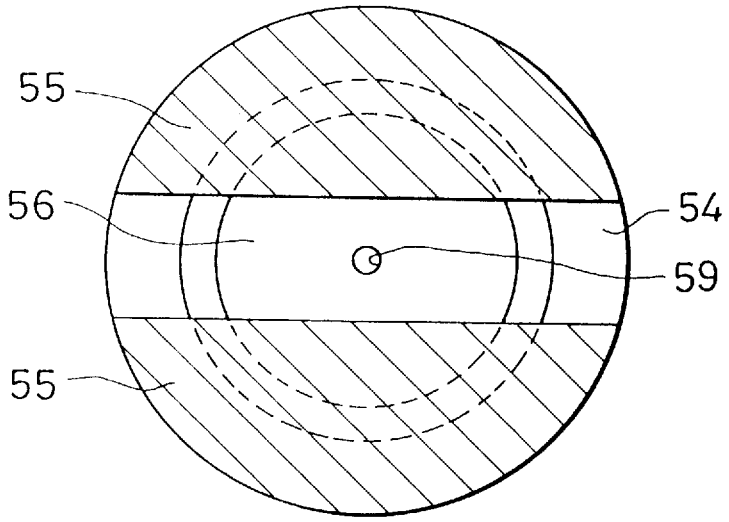

The check valve 43 may be constituted by employing a ball valve, but it may be constituted of a flat valve instead, which offers better response. FIG. 5 presents a structural example in which a flat valve is employed. In this example, a first communicating hole 51, which communicates with the high pressure chamber side and a second communicating hole 52 which communicates with the TCV side are formed in the valve housing 50, with a valve element movement space 53 and a rectangular space 54 continuous with the valve element movement space 53 formed between the communicating holes. The valve element movement space 53 is formed in a cylindrical shape which is connected to the second communicating hole 52 with its diameter increased, whereas the rectangular space 54, which is connected to the first communicating hole 51, is formed over a specific distance by side walls 55 that face opposite each other. A valve element 56 is housed in the valve element movement space 53. A first seat portion 57 that comes in contact with the valve element 56 is formed at the staged portion over which the valve element movement space 53 shifts to become the second communicating hole 52, and a second seat portion 58 that comes in contact with the valve element 56 is formed in the area over which the valve element movement space 53 shifts to become the rectangular space 54 (the end surface of the side wall 55 facing opposite the valve element movement space 53). In this structural example, the valve element 56 is constituted of a flat valve whose cross section is circular, with an orifice 59 formed at the center, the diameter of the valve element set smaller than the diameter of the valve element housing space 53 but larger than the diameter of the second communicating hole 52, and the thickness of the valve element set smaller than the distance between the first seat portion 57 and the second seat portion 58.

In the structure described above, every time the rollers 11 begin to ride up on the cam lobes 12*a* of the cam ring 12, a drive reactive force is momentarily applied to the timer piston 8 in the direction in which the high pressure chamber is compressed (in the retarding direction), and each time this happens, the pressure in the high pressure chamber is sharply increased. This sharp change in the pressure would be communicated as a shock wave via the communicating passage, but when the check valve that is provided at the passage 38 receives this shock wave, the valve element 56 of the check valve 43 immediately comes into contact with the first seat portion 57 to block off the second communicating hole 52 so that the communication of the shock wave is blocked by the valve element 56. Thus, the movement of the timer piston 27 is inhibited to maintain the timer advance angle that has been set.

While a rapid reduction in the pressure in the high pressure chamber is prevented by the check valve 43 in this manner, the valve element 56 also comes into contact with the first seat portion 57 in a similar manner as indicated by the solid line in FIG. 3, when spilling the high pressure fuel into the low pressure chamber with the TCV 35, so that the fuel in the high pressure chamber 29 is delivered to the side space 36 via the orifice 59 formed at the valve element. Thus, the pressure in the high pressure chamber is gradually reduced until the desired advance angle is achieved, and the timer piston is displaced in the retarding direction to the position at which the pressure difference between the pressure in the high pressure chamber and the pressure in the low pressure chamber is in balance with the spring force imparted by the timer spring.

In contrast, when the TCV 35 is closed in a state in which the pressure in the high pressure chamber is reduced, the high pressure fuel is gradually guided from the chamber 2 to the side space 36 via the orifice communicating passage 37 and, as a result, the valve element 56 comes into contact with the second seat portion 58 to open the second communicating hole 52 into the valve element movement space 53, as indicated with the broken line in FIG. 5, resulting in the fuel in the side space 36 traveling around the valve element 56 to flow into the rectangular space 54 and the first communicating hole 51 to finally reach the high pressure chamber 29. Thus, the pressure in the high pressure chamber increases to the level at which the desired advance angle is achieved.

As explained above, since the high pressure chamber 29 at the timer device 43 and the passage 39 communicating with the side space 36 are connected with each other by the passage 38 at the high pressure side cover member 30 which is an integrated part of the sleeve 26, the seal extending from the high pressure chamber 29 to the check valve 43 is no longer required. In addition, since the check valve 43 is a member that is independent of the timer piston 27, the timer piston 27 and the check valve 43 can be designed and manufactured separately.

In addition, while a seal structure is required in the area where the high pressure side cover member 30 and the housing 4 come in contact with each other at the non-high pressure chamber side of the check valve 43, since the shock wave generated in the high pressure chamber 29 is blocked by the check valve 43, rigorous seal management is not required and regular seal management will suffice. This is one of the major advantages achieved by providing the check valve at the high pressure side cover member 30. If the check valve was provided at the passage 39 in the housing, the shock wave would reach the area where the high pressure side cover member 30 and the housing 4 are in contact with each other, thereby necessitating a rigorous seal structure in the area and, furthermore, there is a concern that such a rigorous seal structure could not be maintained because of the difference in thermal expansion between the housing 4 and the high pressure side cover member 30. Thus, it leads to the conclusion that significant advantages are achieved through this structure, in the ease with which the check valve may be mounted and in assuring an appropriate seal structure.

Moreover, in the structure described above, since the timer piston 27 and the timer sleeve 26 are both constituted of steel, the clearance between the timer piston 27 and the sleeve 26 hardly changes due to changes in temperature, thereby making it possible to improve on the slidability and the durability of the timer piston 27.

Figure 6:
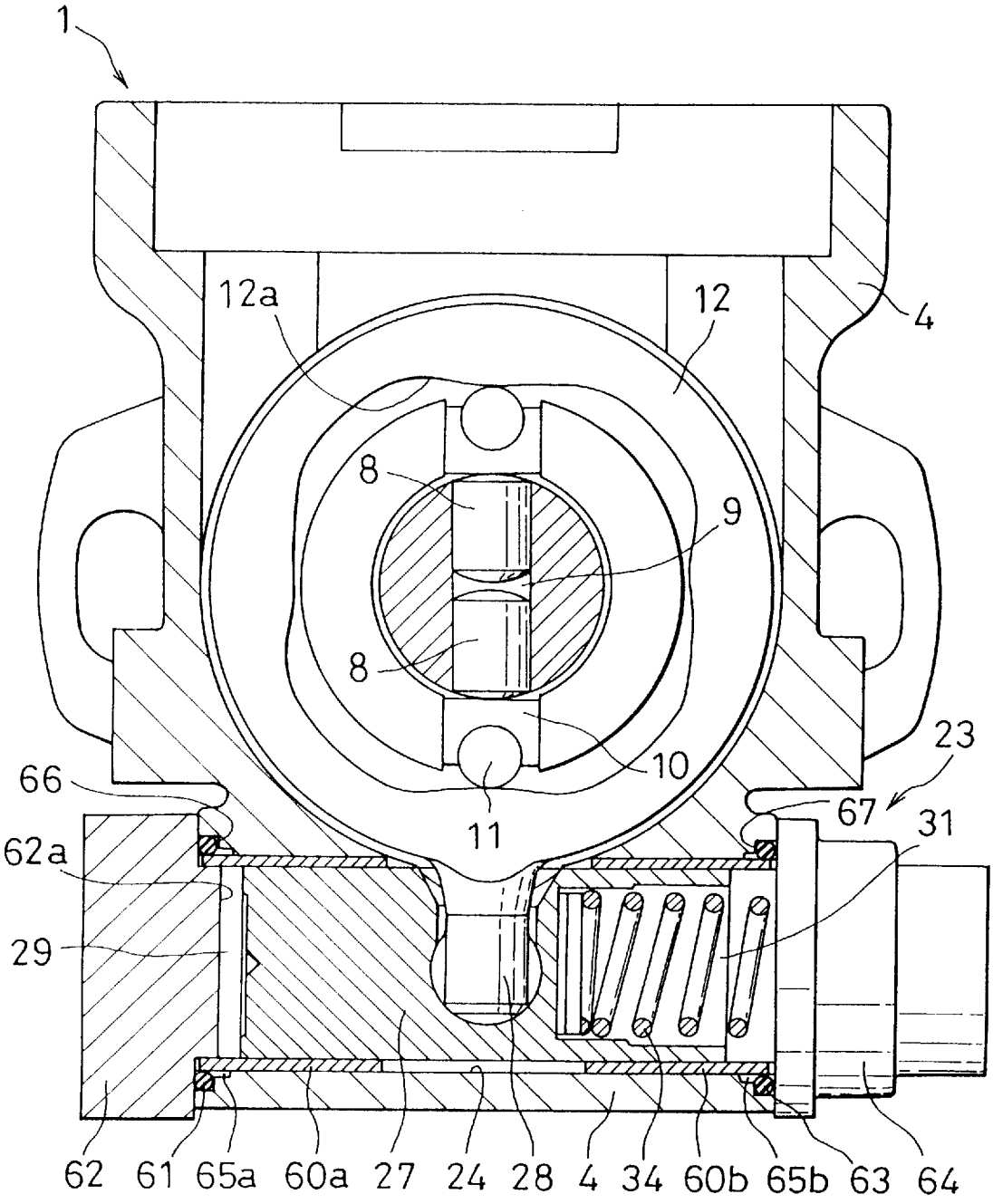
FIG. 6 is a cross section illustrating another structural example of the timer device.

FIG. 6 shows another structural example of a timer device 23. In this structural example, sleeves 60*a* and 60*b* fitted in a cylindrical hole 24 in the housing 4 are provided separately at the two sides, avoiding the area where a slide pin 28 which constitutes an integrated part of the cam ring 12 is inserted, with the timer piston 27 inserted so that the timer piston 27 slides in contact with the sleeve 60*a* and 60*b*. The high pressure chamber 29 formed at one end of the timer piston 27 is constituted by blocking off the opening end of the cylindrical hole 24 at the high pressure side with a high pressure side cover member 62 which is secured to the housing 4 with a bolt, whereas the low pressure chamber 31 formed at the other end is constituted by blocking off the opening end of the cylindrical hole 24 at the low pressure side with a low pressure side cover member 64 which is secured to the housing 4 with a bolt.

While the sleeves 60*a* and 60*b* may be entirely constituted of steel, if constituting them entirely of steel proves to make the machining more difficult, a structure that facilitates machining may be achieved by constituting the base material of a ferrite material and coating the circumferential surface with copper. Using a material coated with copper in this manner also achieves an advantage in that smooth movement of the timer piston can be assured. It is to be noted that in this embodiment, too, the housing is constituted of aluminum and the timer piston 27 and the cover members 62 and 64 are constituted of steel.

In addition, the high pressure chamber 29 communicates with the TCV via the check valve, and by varying the pressure in the high pressure chamber with the TCV, the position of the timer piston is controlled. While there may be specific features that are different from those in the structural example explained earlier, its basic structure is similar to that presented in the schematic diagram in FIG. 4.

The outer opening end surfaces of the timer sleeves 60*a* and 60*b* are not completely in contact with the cover members 62 and 64 and they are made to face opposite the cover members with a specific clearance in between in consideration of possible thermal deformation. In addition, staged portions 66 and 67 for mounting o-rings 61 and 63 are formed at the circumferential edges of the end portions of the cylindrical hole at the housing 4, and the o-rings 61 and 63 provided at the staged portions 66 and 67 are also placed on the external circumferential surfaces of the ends of the timer sleeves 60*a* and 60*b* and clamped in a state in which they are compressed by the housing 4, the timer sleeves 60*a* and 60*b* and the cover members 62 and 64.

Furthermore, at the opening end of the timer sleeve 60*a* that faces opposite the high pressure side cover member 62, a projecting portion 62*a* which is an integrated part of the cover member 62 is lightly pressed in or fitted partially in. This projecting portion 62*a* is formed to have an end surface whose shape matches the internal shape of the opening end portion of the sleeve 60*a* and the degree to which it is fitted in is approximately a few millimeters from the opening end, since a tight pressed-in state is not required. In contrast, no such projecting portion is formed at the low pressure side cover member 64. Consequently, while the o-ring 61 in the high pressure side may come in contact with the fuel that leaks out via the clearance between the projecting portion

62*a* and the timer sleeve 60*a*, it is basically provided on the outside of the high pressure chamber 29.

Moreover, gaps 65*a* and 65*b* extend along the external circumferential surface with the timer sleeve 60*a*, continuous to the staged portions 66 and 67 for mounting the o-rings 61 and 63, between the opening end of the timer sleeve 60*a* facing opposite the cover member 62 and the housing 4 and between opening end of the timer sleeve 60*b* facing opposite the cover member 64 and the housing. These gaps 65*a* and 65*b* are designed so that they extend from the staged portions 66 and 67 over a few millimeters. The gaps 65*a* and 65*b* are provided to absorb any deformation of the cylindrical hole 24 which is caused by its internal surface becoming distended inward when the bolts securing the cover members 62 and 64 to the housing 4 in the vicinity of the cylindrical hole 24 are tightened hard. In addition, since such deformation through distension occurs in the vicinity of the opening ends of the cylindrical hole 24, it is necessary to form the gaps 65*a* and 65*b* over the range at which such deformation is anticipated. Consequently, the range over which the gaps 65*a* and 65*b* extend should be reset to correspond to varying deformation ranges of the housing 4. It is to be noted that the gap 65*a* is formed to extend to a position which is further away from the opening end of the timer sleeve 60*a* than the projecting portion 62*a* at the cover member 62. Since the other structural features are identical to those in the structural example explained earlier, the same reference numbers are assigned to identical components and their explanation is omitted.

In this structure, while the high pressure side cover member 62 is formed separate from the timer sleeve 60*a*, since the projecting portion 62*a* of the cover member 62 is fitted in the opening end portion of the timer sleeve 60*a*, the o-ring 61 is not directly subject to the shock wave which is generated when the rollers 11 begin to ride up on the cam lobes 12*a*, thereby eliminating the likelihood of the o-ring 61 becoming damaged. In addition, since the projecting portion 62*a* of the cover member 62 only needs to be fitted in the sleeve 60*a* to a degree to which the o-ring 61 is protected, it is not necessary to allow a deep insertion of the projecting portion 62*a*. Thus, by minimizing the insertion quantity, the range of movement (L) of the timer piston can be increased to set the ratio (L/D) of the range of movement (L) and the diameter (D) of the timer piston at an advantageous value.

Furthermore, by providing the gaps 65*a* and 65*b*, the timer sleeves 60*a* and 60*b* can be effectively prevented from becoming damaged. In other words, without the gaps 65*a* and 65*b*, there will be a concern that the opening end portion of the timer sleeve 60*a* may become tightly clamped between the housing 4 and the projecting portion 62*a* and become damaged as a result, through deformation of the sliding surfaces of the timer sleeve 60*a* and 60*b* resulting from the tightening of the bolts explained earlier, through the end portion of the timer sleeve 60*a* becoming expanded when the projecting portion 62*a* is fitted therein, or through the difference in the thermal expansion between the housing 4 and the cover member 62. However, the stress which may otherwise be applied to the timer sleeve 60*a* can be alleviated by the gap 65*a*.

It is to be noted that while the present invention is adopted in a VR type injection pump in the structural examples explained above, a basically identical structure may be adopted in a VE type injection pump, with a different member for linking with the timer piston 27 employed.

As has been explained, according to the present invention, common advantages are achieved in that by improving on the structure of the timer piston at the high pressure side, a timer device that is less likely to become damaged and facilities the production management is provided to improve productivity and in that a timer device with a high degree of reliability is achieved through an improvement in the durability.

In particular, by constituting the high pressure chamber with a high pressure side cover member which is formed as an integrated part of the timer sleeve and connecting the high pressure chamber with the passage communicating with the high pressure side fuel path through a communicating passage at the high pressure side cover member, the necessity for forming the communicating passage by machining the timer sleeve as in the prior art is eliminated. Thus, the precision at the sliding surface is improved to achieve better slidability and better abrasion resistance properties for the timer piston, which, in turn, will reduce incidence of failure. In addition, design and production of the communicating passage are facilitated, and the structure of the communicating passage itself is simplified.

Especially, if the valve mechanism is to be provided at the communicating passage at the high pressure side cover member, the sealing extending from the high pressure chamber to the valve mechanism is not required, and even when a seal is required beyond the valve mechanism, the shock wave will be blocked by the valve mechanism, thereby making it possible to simplify the seal structure. In addition, since the timer piston and the valve mechanism can be separately designed and manufactured, damage to the valve mechanism does not directly result in damage to the timer piston, thereby making it possible to provide a practical timer device whose productivity, durability and reliability are improved compared to those in the prior art. Furthermore, since the movement of the timer piston is not directly communicated to the valve mechanism, stable movement of the valve mechanism is assured.

Moreover, by constituting the high pressure chamber and the low pressure chamber with cover members that are separate from the timer sleeve and providing a projecting portion at the high pressure side cover member which fits inside the opening end portion of the timer sleeve, the seal member between the housing and the high pressure side cover member is not directly subject to the high pressure fuel and the shock wave and is thereby prevented from becoming damaged and is, therefore, effectively protected. In addition, the projecting portion may be fitted inside the timer sleeve with little insertion as long as the seal member is protected from the high pressure fuel and the shock wave, and thus, by setting the ratio (L/D) of the slidable range (L) and the diameter (D) of the timer piston at a large value, the timer performance can be improved.

In this structure for fitting in the projecting portion, a gap further extends from the area where the seal member is provided at the opening end of the timer sleeve between the opening end of the timer sleeve and the housing. The deformation of the housing occurring when the cover member is secured to the housing by tightening a bolt and an expansion at the opening end portion of the timer sleeve that occurs when the projecting portion is fitted therein can be absorbed by this gap, thereby preventing any deformation of the sliding surface of the timer sleeve and preventing the timer sleeve from being damaged.

What is claimed is:

1. A timer device for adjusting force-feed timing of a distributor type fuel injection apparatus that distributes and force-feeds fuel by compressing the fuel, said timer device comprising:

a timer piston that adjusts an advance angle quantity;

a timer sleeve secured to a housing, said timer piston being slidably inserted in said timer sleeve;

a high pressure side cover member secured to said housing, which is an integrated part of said timer sleeve and forms a high pressure chamber which is to be filled with fuel from a high pressure fuel path between said high pressure side cover member and one end of said timer piston;

a low pressure side cover member secured to said housing and which is constituted as a member separate from said timer sleeve, a low pressure chamber which communicates with a low pressure fuel path being formed between said low pressure side cover member and another end of said timer piston; and a timer spring provided at said low pressure chamber to apply a force to said timer piston toward said high pressure chamber;

wherein the position of said timer piston is adjusted through achieving balance between a pressure difference between pressures at said high pressure chamber and said low pressure chamber and a spring force imparted by said timer spring; and wherein a communicating passage that connects said high pressure chamber with a passage communicating with said high pressure fuel path is formed at said high pressure side cover member.

2. A timer device for a distributor type fuel injection apparatus according to claim 1, wherein:

a control valve for adjusting the pressure in said high pressure chamber is provided at said passage communicating with said high pressure side fuel path.

3. A timer device for a distributor type fuel injection apparatus according to claim 2, wherein:

fuel in said high pressure fuel path is supplied to said passage communicating with said high pressure fuel path via an orifice and fuel in said passage is spilled into said low pressure chamber by opening said control valve.

4. A timer device for a distributor type fuel injection apparatus according to claim 1, wherein:

a valve mechanism, that constricts said communicating passage when fuel pressure in said high pressure chamber becomes higher than fuel pressure within said passage communicating with said high pressure side fuel path and releases constriction of said communicating passage when the fuel pressure in said high pressure chamber becomes lower than the fuel pressure within said passage communicating with said high pressure side fuel path, is provided at said high pressure side cover member.

5. A timer device for a distributor type fuel injection apparatus according to claim 4, wherein:

said valve mechanism is constituted by forming a valve element housing space for housing a valve element within a valve housing provided at said high pressure side cover member, housing, inside said valve element housing space, a flat valve element having an orifice, and forming a first seat portion where said valve element seats to allow communication between said valve element housing space and said passage communicating with said high pressure side fuel path only via an orifice in said valve element and a second seat portion where said valve element sits to allow communication between said valve housing space and said high pressure chamber via the periphery of said valve element in an area of said valve housing where said valve element housing space is formed.

6. A timer device for a distributor type fuel injection apparatus according to claim 1, wherein:

said timer piston, said timer sleeve and said high pressure side cover member are constituted of the same material.

7. A timer device for a distributor type fuel injection apparatus according to claim 6, wherein:

said housing is constituted of aluminum, and said timer piston, said timer sleeve and said high pressure side cover member are constituted of steel.

8. A timer device for adjusting force-feed timing of a distributor type fuel injection apparatus that distributes and force-feeds fuel by comprising the fuel, said timer device comprising:

a timer piston that adjusts an advance angle quantity;

a timer sleeve secured to a housing, said timer piston being slidably inserted in said timer sleeve;

a high pressure side cover member secured to said housing via a seal member, said high pressure side cover member being a member separate from said timer sleeve, and a high pressure chamber which is to be filled with fuel from a high pressure fuel path being formed between said high pressure side cover member and one end of said timer piston;

a low pressure side cover member secured to said housing via a seal member and which is constituted as a member separate from said timer sleeve, a low pressure chamber which communicates with a low pressure fuel path being formed between said low pressure side cover member and another end of said timer piston; and a timer spring provided at said low pressure chamber;

wherein the position of said timer piston is adjusted through achieving balance between a pressure difference between pressures at said high pressure chamber and said low pressure chamber and a spring force imparted by said timer spring; and wherein a projecting portion is formed in a shape matching the internal shape of an opening end portion of said timer sleeve at said high pressure side cover member and said projecting portion is fitted in said opening end portion of said timer sleeve with said high pressure side cover member secured to said housing.

9. A timer device for a distributor type fuel injection apparatus according to claim 8, wherein:

said projecting portion at said high pressure side cover member is lightly pressed in at said opening end portion of said timer sleeve.

10. A timer device for a distributor type fuel injection apparatus according to claim 8, wherein:

said seal member provided between said housing and said timer sleeve is located on the outside of said opening end portion of said timer sleeve, and gaps further extending inward along an external circumferential surface of said timer sleeve are formed from the position where said seal member is provided.

11. A timer device for a distributor type fuel injection apparatus according to claim 8, wherein:

said seal member is provided in a state in which said seal member is compressed within a space enclosed by said housing, said high pressure side cover member and said opening end portion of said timer sleeve.

12. A timer device for a distributor type fuel injection apparatus according to claim 8, wherein:

said gap is formed extending to a position that is further away from said opening end portion of said timer sleeve than said projecting portion at said high pressure side cover member.

13. A timer device for a distributor type fuel injection apparatus according to claim 8, wherein:

said timer sleeve is divided into a side toward one end of said timer piston and another side toward another end of said timer piston, to be secured to said housing.

14. A timer device for a distributor type fuel injection apparatus according to claim 8, wherein:

said timer piston, said timer sleeve and said high pressure side cover member are constituted of the same material.

15. A timer device for a distributor type fuel injection apparatus according to claim 11, wherein:

said housing is constituted of aluminum, and said timer piston, said timer sleeve and said high pressure side cover member are constituted of steel.

16. A timer device for a distributor type fuel injection apparatus according to claim 8, wherein:

said housing is constituted of aluminum, said timer piston and said high pressure side cover member are constituted of steel and said timer sleeve is constituted of a base material coated with copper on a circumferential surface thereof.

* * * * *